US008337235B2

(12) United States Patent
Mizutani et al.

(10) Patent No.: US 8,337,235 B2
(45) Date of Patent: Dec. 25, 2012

(54) CONNECTOR WITH CURVED COUPLING BETWEEN LOCK ARM AND HOUSING

(75) Inventors: Yoshihiro Mizutani, Yokkaichi (JP); Takao Hata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/403,286

(22) Filed: Feb. 23, 2012

(65) Prior Publication Data

US 2012/0219357 A1 Aug. 30, 2012

(30) Foreign Application Priority Data

Feb. 28, 2011 (JP) ..... 2011-041341
Feb. 8, 2012 (JP) ..... 2012-024979

(51) Int. Cl.
*H01R 13/627* (2006.01)

(52) U.S. Cl. ..... 439/358; 439/352

(58) Field of Classification Search ..... 439/350–358
See application file for complete search history.

(56) References Cited

U.S. PATENT DOCUMENTS

| | | | | |
|---|---|---|---|---|
| 5,378,168 | A | 1/1995 | Sumida | |
| 5,591,041 | A * | 1/1997 | Cecil et al. | 439/352 |
| 6,234,826 | B1 * | 5/2001 | Wilber et al. | 439/352 |
| 6,435,895 | B1 * | 8/2002 | Fink et al. | 439/352 |
| 6,780,045 | B2 * | 8/2004 | Shuey et al. | 439/489 |
| 7,399,195 | B2 * | 7/2008 | Kim et al. | 439/352 |
| 7,544,081 | B2 * | 6/2009 | Lim | 439/352 |
| 2003/0199193 | A1 | 10/2003 | Amemiya | |
| 2004/0023548 | A1 | 2/2004 | Noro | |
| 2005/0215106 | A1 | 9/2005 | Holub | |
| 2007/0093120 | A1 | 4/2007 | Hardy et al. | |

FOREIGN PATENT DOCUMENTS

| | | |
|---|---|---|
| EP | 1365483 A1 | 11/2003 |
| JP | 2000-150069 | 5/2000 |

* cited by examiner

*Primary Examiner* — Edwin A. Leon
*Assistant Examiner* — Harshad Patel
(74) *Attorney, Agent, or Firm* — Gerald E. Hespos; Michael J. Porco

(57) ABSTRACT

A connector (10) formed by removing front and rear shaping dies in forward and backward directions. The connector (10) includes a housing (20), a lock arm (40) provided displaceably relative to the outer surface of the housing (20) and adapted to hold a mating housing and the housing (20) in a connected state. Couplings (51) connect the lock arm (40) and the housing (20) and have front and rear curved surfaces (57F, 57R). Front steps (54F) extend continuously forward from the end edge (58F) of the front curved surfaces (57F) closer to the rear curved surfaces (57R). Rear steps (54R) extend continuously back from end edges of the rear curved surfaces (57R) closer to the front curved surfaces (57F). Pairs of curved portions (59F, 59R) facing forward and back are provided at opposite ends of the curved surfaces (57F, 57R) in directions crossing the curving directions.

18 Claims, 12 Drawing Sheets

CONNECTOR WITH CURVED COUPLING BETWEEN LOCK ARM AND HOUSING

BACKGROUND OF THE INVENTION

1. Field of the Invention

The present invention relates to a connector.

2. Description of the Related Art

Japanese Unexamined Patent Publication No. 2000-150069 discloses a lock arm structure for holding connectors in a connected state. This structure includes a lock arm supported resiliently on the outer surface of a housing via a coupling portion. The coupling is long in forward and backward directions and is deformed resiliently with displacement of the lock arm. The long coupling advantageously prevents breakage since stress on the coupling is distributed more easily when the lock arm is displaced relative to the outer surface of the housing.

However, a long flow path for resin exists when the coupling is longer, and a filling efficiency of resin during injection molding of the coupling is reduced. Resin filling efficiency could be improved by shortening the coupling and connecting the lock arm to protection walls at the opposite left and right sides of the lock arm. Thus the lock arm is displaced like a seesaw by torsionally deforming the connections to the protection walls. Two curved surfaces may be provided at the opposite front and rear sides of each connection to the protection walls and curves may be provided at the opposite upper and lower corners of each curved surface to alleviate stress in a torsional direction to prevent breakage of the connections. Forming the curves over the entire corner portions of the curved surfaces requires a slide structure and leads to a cost increase of a shaping die.

The present invention was completed in view of the above situation and an object thereof is to provide curved portions over substantially the entire corner portions of curved surfaces of a coupling portion without providing a slide structure.

SUMMARY OF THE INVENTION

The invention relates to a connector with a housing and a lock arm that is displaceable relative to the outer surface of the housing. The lock arm is configured to hold a mating housing and the housing in a connected state. A coupling connects the lock arm and the housing and has front and rear curved surfaces. A front step extends continuously forward from an end edge closer to the rear curved surface in a curving direction and a rear step extends continuously back from an end edge closer to the front curved surface in a curving direction. Two curved portions substantially facing forward and backward are provided at opposite ends of each curved surface in a direction crossing the curving direction.

The prior art coupling with curved surfaces facing forward and back and curves at corners of the curved surfaces would have opposite sides of the curved surfaces formed by vertical surfaces without steps. However, the curves disappear at end edges of the curved surfaces in curving directions if shaping dies are removed in forward and backward directions. Thus, it has not been possible to provide the curved portions over the entire corners. However, the curved portions can be formed over the entire periphery of the coupling by using only front and rear shaping dies by providing the front step extending continuously forward from the end edge of the front curved surface and providing the rear step extending continuously extending back from the end edge of the rear curved surface. The curved portions can be formed in an area extending from the front curved surface to the front step and an area extending from the rear curved surface to the rear step, with these areas crossing the end edges of the both curved surfaces. Thus, the curved portions can be formed also at the end edges of the both curved surfaces of the coupling. Therefore, the curved portions can be provided over the entire corners of the curved surfaces of the coupling without providing a slide structure.

The steps may overlap when seen in forward and backward directions. Thus, an area sandwiched between the steps in forward and backward directions is thick to reinforce the coupling.

The steps may be arranged substantially symmetrically with respect to the coupling. Thus, stress acting on the coupling can be distributed to the steps in a well-balanced manner.

Two protection walls may stand up from the outer surface of the housing opposite sides of the lock arm, and two couplings may connect the protection walls and the lock arm. According to this construction, the coupling is deformed and twisted resiliently as the lock arm is displaced relative to the outer surface of the housing. However, the curves prevent stress in a torsional direction that might otherwise break the coupling.

The coupling may be arranged between the steps. More particularly, the coupling may be in an area enclosed by a tangent drawn from an end edge of the front curved surface to the rear curved surface, a tangent drawn from an end edge of the rear curved surface to the front curved surface and the two curved surfaces.

The front curved surface substantially facing forward via a front slit may be connected to a rear edge of a vertical surface of the front step and/or the rear curved surface substantially facing backward via a rear slit may be connected to a front edge of a vertical surface of the rear step.

A laterally projecting restricting piece may be provided on the lock arm and a bulging piece may bulge laterally on an inner surface of the protection wall. The restricting piece and the bulging piece may face one another vertically to prevent an excessive deformation of the lock arm when an improper connecting operation is performed.

At least one link may be arranged at a side of the lock arm connecting a side surface of an arm of the lock arm and a side surface of the protection wall. The link may include one or more beams adjacent to the coupling. The beams preferably extend in substantially forward and backward directions.

A front beam may be wider than a rear beam, and a front surface of the front beam may be closer to the protection wall than a rear surface of the rear beam-shaped.

The coupling may be substantially parallel to the upper surface of the housing. coupling a lateral edge of the lock arm and the housing and having a pair of front and rear curved surfaces.

The front step may extend substantially continuously forward from an end edge of the front curved surface more distant from the lateral edge of the lock arm in an R direction. The rear step may extend substantially continuously back from an end edge closer to the lateral edge of the lock arm of the rear curved surface in an R direction. Upper and lower curved portions face substantially forward and backward and are provided in the entire areas of upper and lower peripheral edges of each curved surface substantially parallel to the upper surface of the housing. Accordingly, the upper and lower curved portions are provided in the entire areas of the upper and lower peripheral edges of a curved surface without providing a slide structure.

The prior art coupling with facing surfaces extending substantially continuously from both end edges of a curved surface in an R direction while substantially facing each other would have vertical surfaces without steps. Thus, even if both curved surfaces of the prior art coupling portion were arranged to face forward and backward and if curves were provided on upper and lower peripheral edges of each curved surface, the curves would disappear at end edges of the curved surfaces in the R direction if shaping dies were removed in forward and backward directions. Thus, it has not been possible to provide the curved portions in the entire areas of the upper and lower peripheral edges of each curved surface. However, the curved portions of the subject invention can be formed in the entire areas of the upper and lower peripheral edges of each curved surface by using only front and rear shaping dies by providing the front step extending continuously forward from the end edge of the front curved surface and providing the rear step extending continuously back from the end edge of the rear curved surface. More particularly, the curved portions can be formed in an area extending from the front curved surface to the front step and an area extending from the rear curved surface to the rear step. The end edges of the curved surface are arranged at least partly in the area enclosed by these curved portions. Thus, the curved portions can be formed without being lost also at the end edges of the curved surface. Therefore, the pair of upper and lower curved portions can be provided in the entire areas of the upper and lower peripheral edges of the curved surface without providing a slide structure.

The front curved surface and the rear curved surface may be offset in a direction crossing both forward and backward directions and a displacing direction of the lock arm. Thus, the coupling can be made wider and stronger by locating these curved surfaces distant from each other.

The front step may be arranged before the coupling and the rear step may be arranged behind the coupling. Thus, stress acting on the coupling can be distributed to the respective front and rear steps in a well-balanced manner.

The lock arm preferably is between two protection walls that standing up from the outer surface of the housing and two of the couplings may be provided to connect the protection walls and lateral edges of the lock arm. The couplings are deformed torsionally when displacing the lock arm vertically relative to the upper surface of the housing. However, the curved portions prevent stress-related breakage of the couplings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
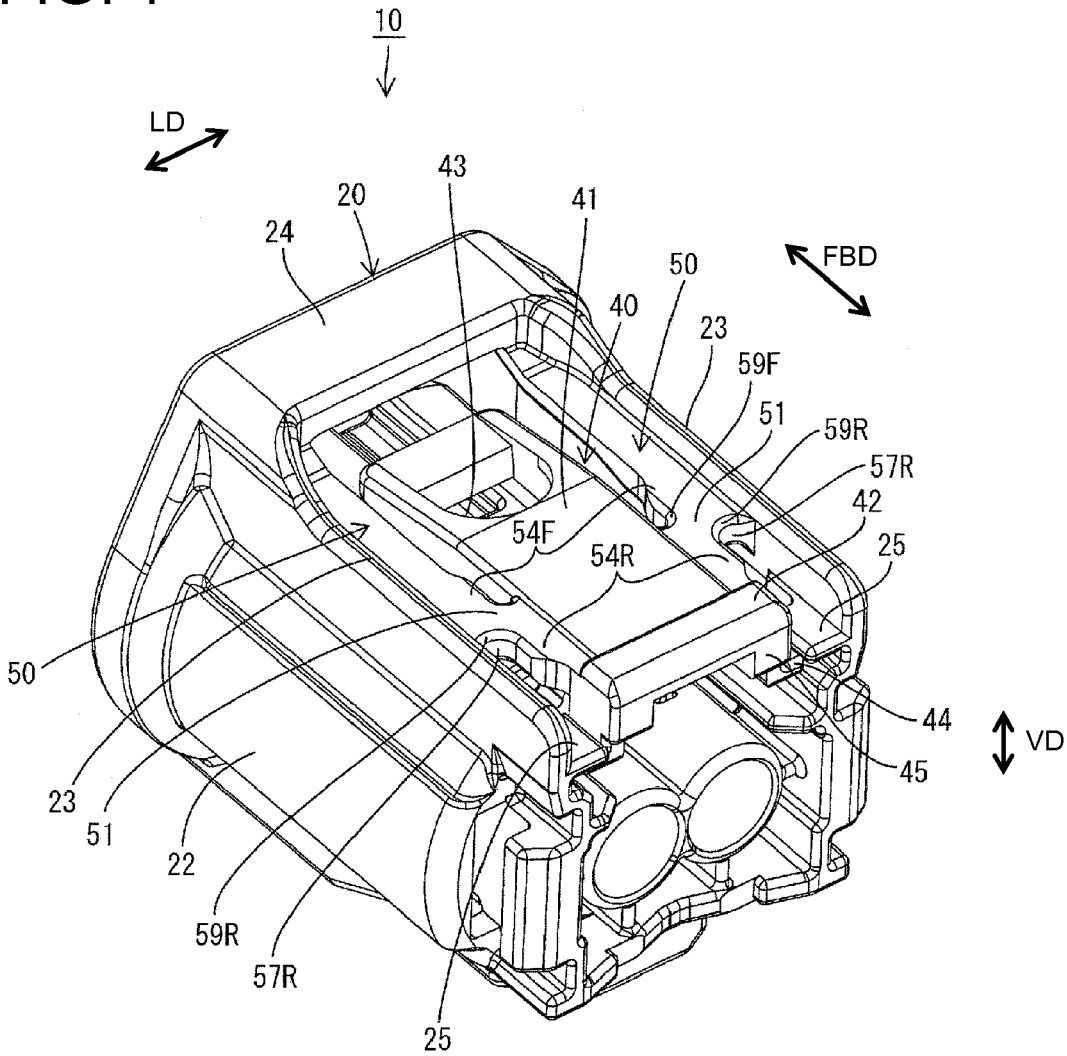
FIG. 1 is a perspective view of a connector according to an embodiment.
Figure 2:
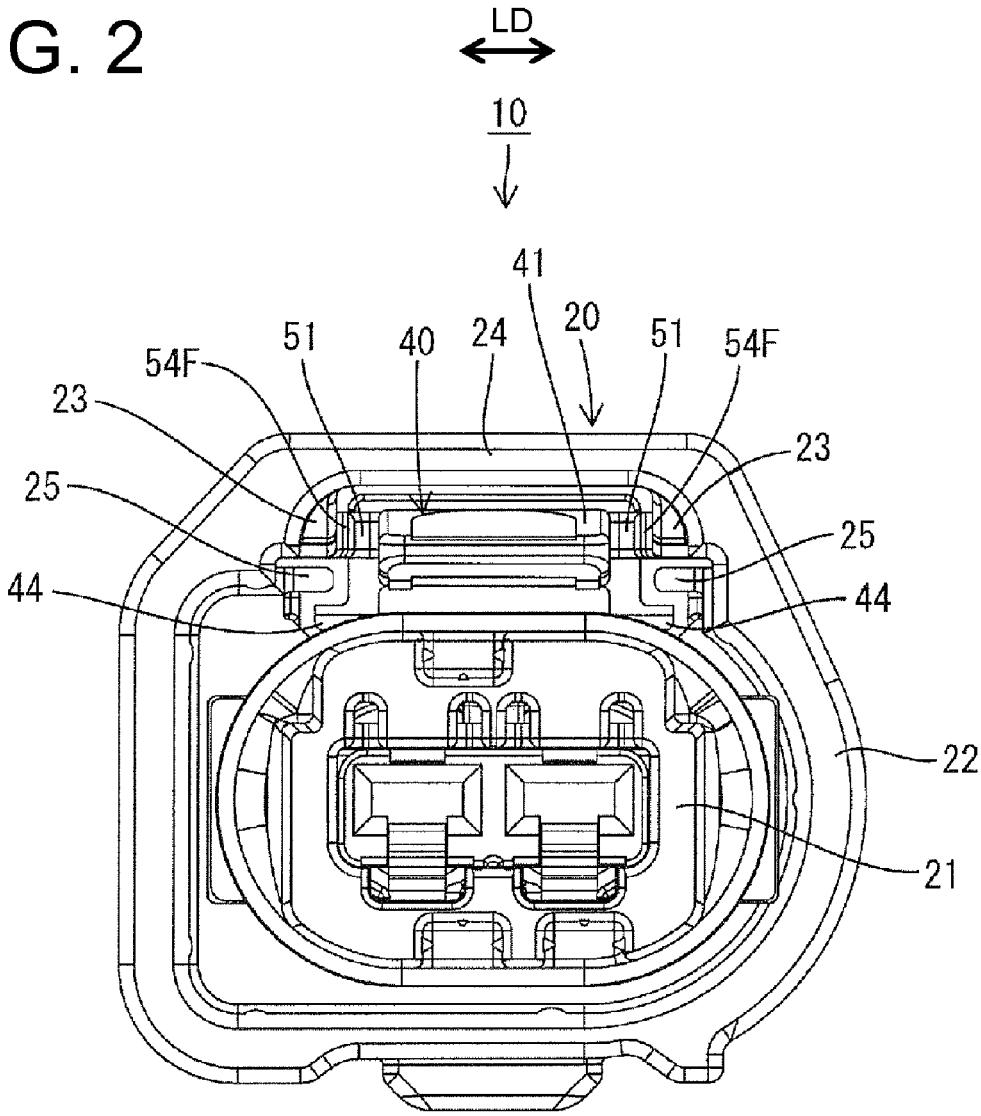
FIG. 2 is a front view of the connector.

An embodiment of the invention is described with reference to FIGS. 1 to 12. A connector 10 of this embodiment includes is shown in FIG. 1 and includes a housing 20 made e.g. of synthetic resin. The housing 20 is connectable to a mating housing (not shown). In the following description, connecting directions of the connector 10 and the mating connector are referred to as forward and backward directions FBD and ends thereof to be connected are referred to as front ends. The housing 20 is to be formed by removing front and rear shaping dies (not shown) in forward and backward directions FBD.

Figure 4:
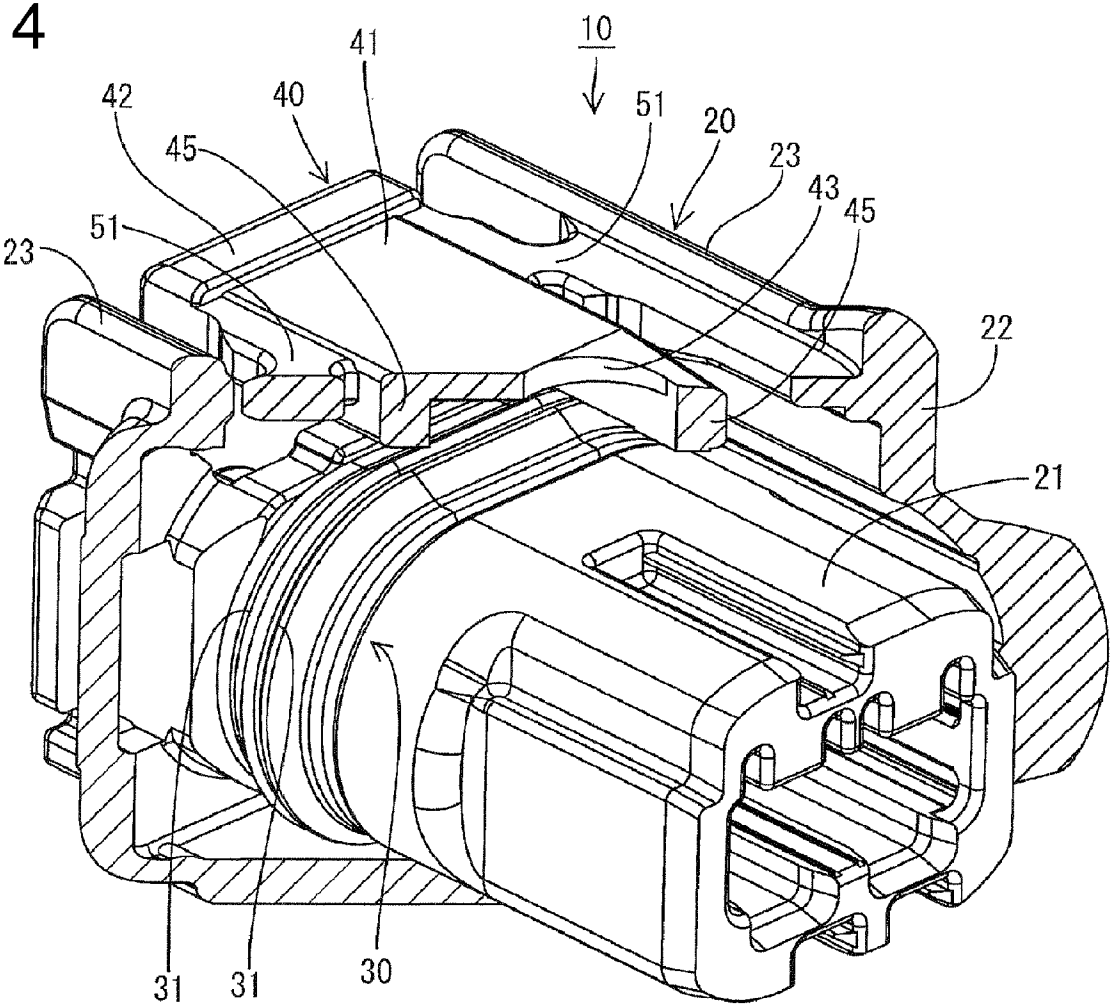
FIG. 4 is a perspective view partly in section along C-C of FIG. 3.
Figure 5:
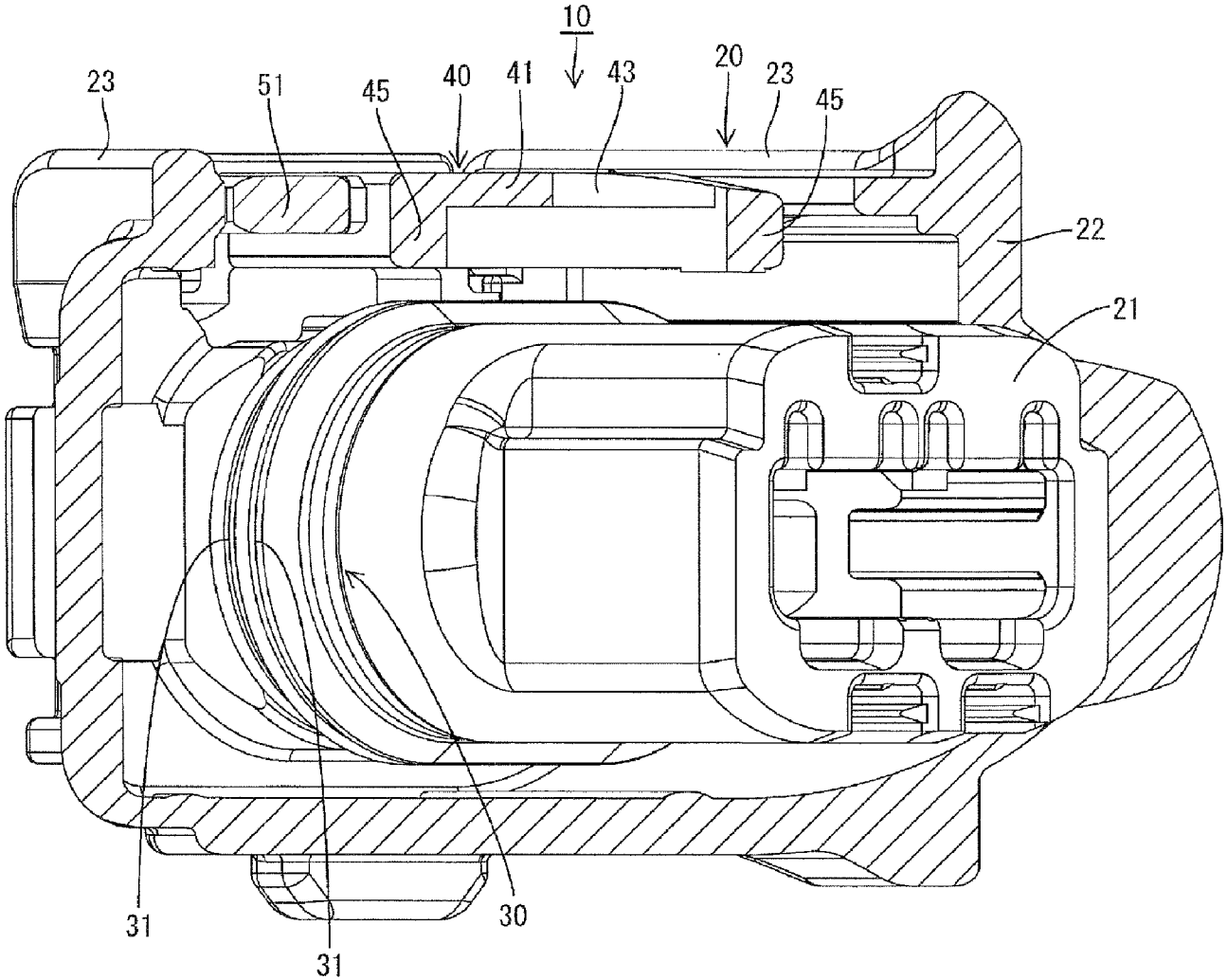
FIG. 5 is a perspective view partly in vertical section along C-C of FIG. 3.
Figure 6:
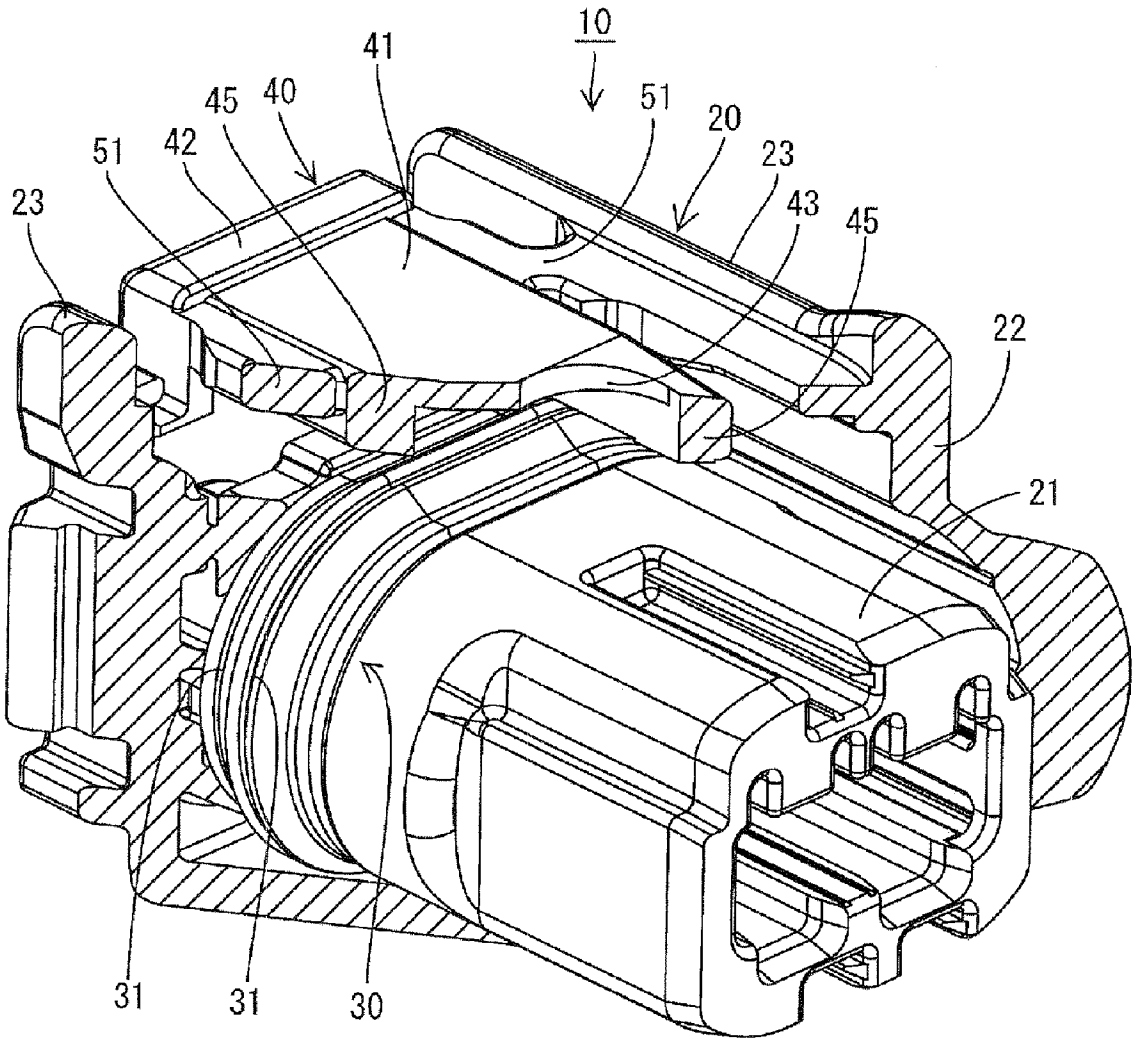
FIG. 6 is a perspective view partly in section along D-D of FIG. 3.
Figure 7:
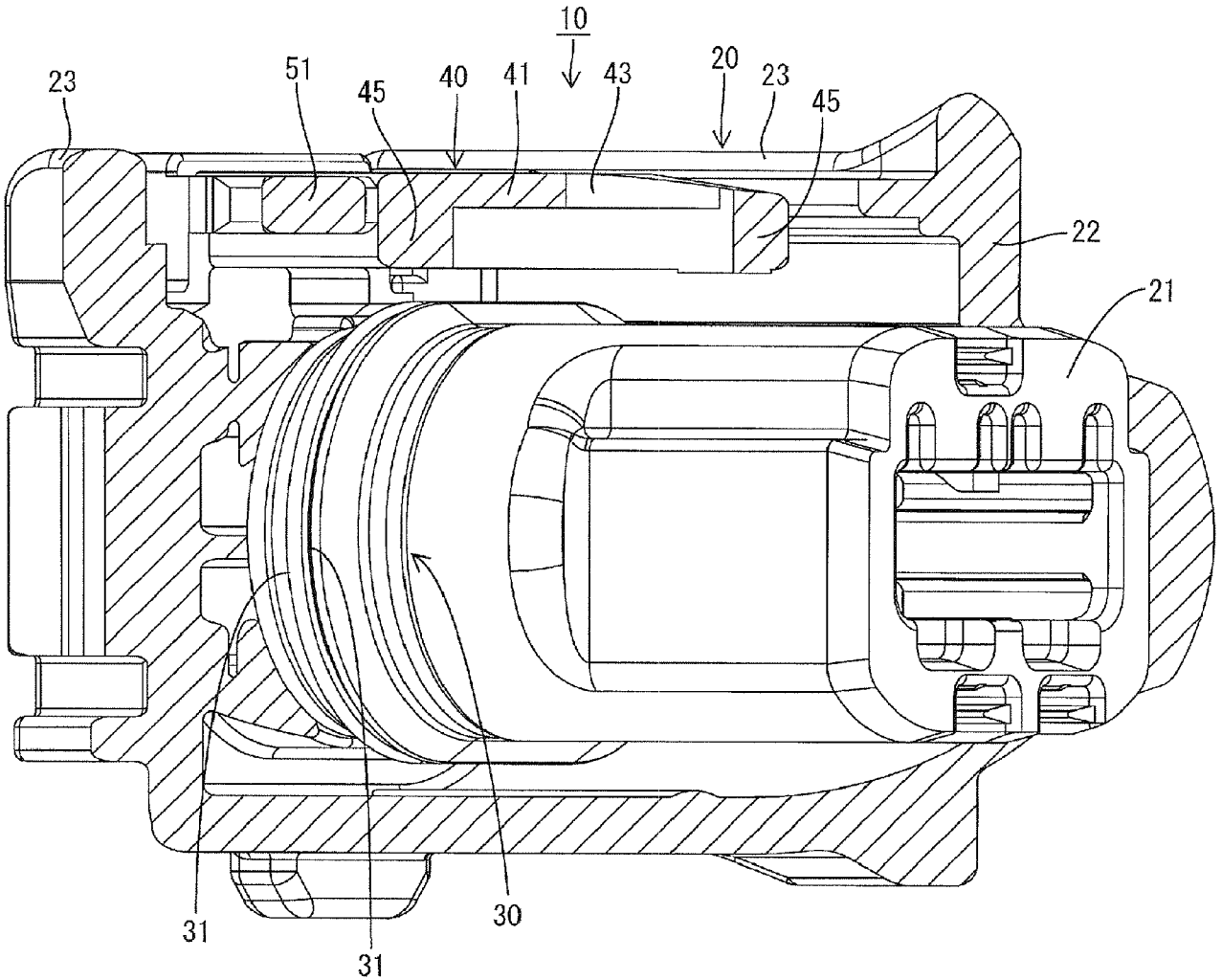
FIG. 7 is a perspective view partly in vertical section along D-D of FIG. 3.

As shown in FIG. 4, the housing 20 includes an inner tube 21 into which one or more female terminal fittings (not shown) can be mounted. Further, an outer tube 21 is provided at an outer side of the inner tube 21 and at least partly covers the inner tube 21. A mating housing includes a forwardly open hood and the connecting portion can be inserted into a clearance between the inner and outer tubes 21 and 22 as the connector 10 and the mating connector are connected.

A rubber sealing ring 30 is mounted on a rear part of the outer peripheral surface of the inner tube 21. Lips 31 are provided circumferentially on the rubber ring 30, and a fitting groove (not shown) is formed in the outer peripheral surface of the inner tube 21 for receiving the rubber ring 30. The rubber ring 30 is squeezed between the connecting portion and the inner tube 21 so that the lips 31 are held in close contact with the inner peripheral surface of the connecting portion over substantially the entire periphery and the inner peripheral surface of the rubber ring 30 is held in close contact with the bottom surface of the fitting groove over substantially the entire periphery. Thus, the interior of the inner tube 21 is watertight.

As shown in FIG. 1, the outer tube 22 has an open upper side, and left and right protection walls 23 project up from the opening edge of the open upper side. The protection walls 23 extend in forward and backward directions FBD at a specified distance from each other in a lateral direction LD. Further, a front part of the outer tube 22 is raised up to provide a bulge 24. The bulge 24 is in the form of a substantially rectangular flat plate extending in the lateral direction LD, and the opposite left and right sides of the bulge 24 are connected to the front ends of the protection walls 23.

A lock arm 40 extending in forward and backward directions FBD at a position between the protection walls 23. The lock arm 40 is connected to the protection walls 23 via links 50 arranged at the opposite left and right sides of the lock arm 40. The links 50 extend between the side surfaces of the lock arm 40 and the side surfaces of the protection walls 23 that face the lock arm 40. Additionally, the links 50 are flat plates aligned substantially parallel to the upper surface of the inner tube 21. The lock arm 40 includes a flat plate-shaped arm portion 41 that extends in forward and backward directions FBD and an unlocking portion 42 projecting up near a rear end of the arm 41. Further, a lock hole 43 penetrates a front part of the arm portion 41 in a plate thickness direction. On the other hand, a lock projection (not shown) projects up on the upper surface of the connecting portion of the mating housing. The connector 10 and the mating connector are held in a properly connected state by fitting the lock projection into the lock hole 43 to be locked in forward and backward directions FBD. As shown in FIGS. 4 to 7, left and right lateral edges of the arm portion 41 define projecting edges 45 in the form of elongated projections and project down toward the inner tube 21.

Figure 3:
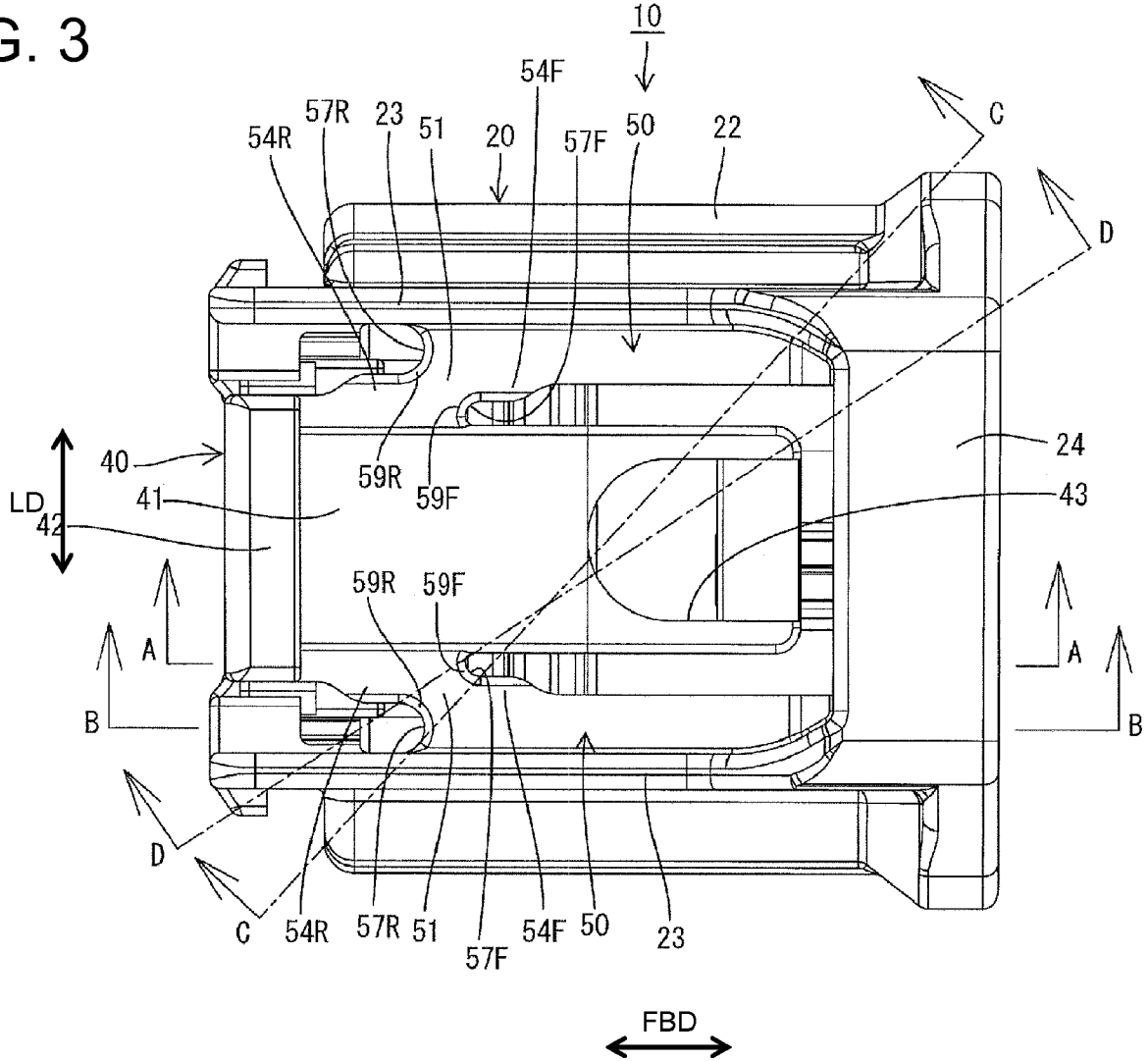
FIG. 3 is a plan view of the connector.
Figure 8:
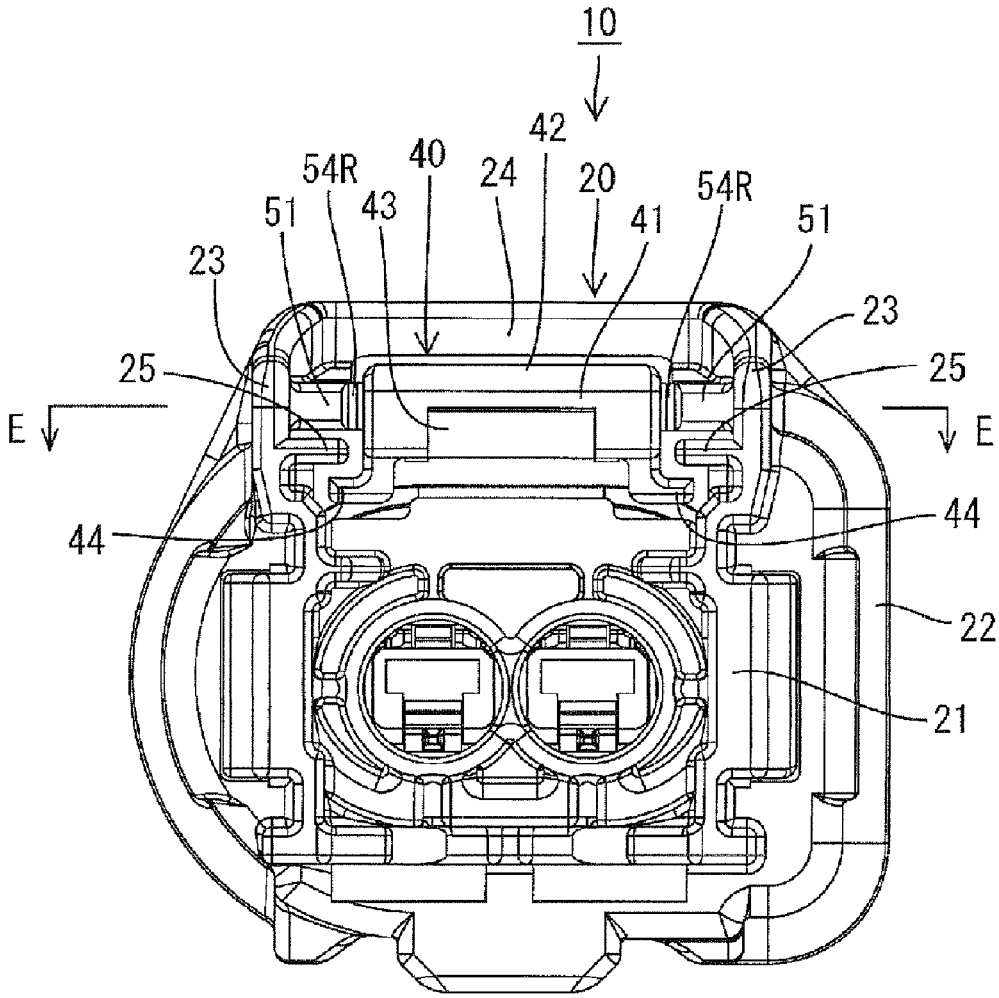
FIG. 8 is a rear view of the connector.

As shown in FIGS. 3 and 8, two L-shaped restricting pieces 44 project sideways on the lower surface of the unlocking portion 42. On the other hand, two bulging pieces 25 bulge sides ways on the inner side surfaces of the protection walls 23 at positions above the restricting pieces 44. The restricting pieces 44 and the bulging pieces 25 at least partly face each other along a vertical direction VD. Thus, the restricting pieces 44 contact the bulging pieces 25 to prevent an excessive deformation of the arm portion 41 when an improper connecting operation such as the one associated with a downward displacement of the front end of the arm portion 41 is performed.

As shown in FIG. 3, the links 50 are substantially are flat plates connecting the side surfaces of the arm portion 41 of the lock arm 40 and the side surfaces of the protection walls 23, and narrow couplings 51 (area hatched by dashed-dotted line in FIG. 10) are provided at the rear ends of the links 50. The front and rear ends of the lock arm 40 can be displaced pivotally like a seesaw relative to the upper surface of the inner tube 21 about the couplings 51. According to this pivotal displacement, the couplings 51 are deformed resiliently and torsionally and stresses acting in a torsional direction may be produced in the couplings 51. Each link 50 includes front and rear beams 52F, 52R adjacent to and at opposite front and rear ends of the coupling 51 and extending in forward and backward directions FBD.

The front beam 52F includes a front side surface 53F laterally facing the side surface of the arm portion 41. The front side surface 53F substantially defines a plane extending in forward and backward directions FBD and vertical direction VD. Similarly, the rear beam 52R includes a rear side surface 53R laterally facing the side surface of the protection wall 23. The rear side surface 53R substantially defines a plane extending in forward and backward directions FBD and vertical direction VD. The front beam 52F is wider than the rear beam 52R, and the front side surface 53F is closer to the protection wall 23 than the rear side surface 53R.

A front step 54F is formed at a rear end of the front side surface 53F of the front beam 52F and is widened to project toward the arm portion 41. On the other hand, a rear step 54R is formed at a front end of the rear side surface 53R of the rear beam 52R and is widened to project toward the protection wall 23. The coupling 51 is between the steps 54F, 54R. Thus, the front step 54F is arranged before the coupling 51 and the rear step 54R is arranged behind the coupling 51 Additionally, the front and rear steps 54F and 54R are substantially point-symmetrical with respect to a center point of the coupling 51 (the center point of an imaginary line connecting both curved surfaces 57F, 57R at a shortest distance) and are arranged one after the other in forward and backward directions with the coupling 51 arranged between the steps 54F, 54R. Accordingly, the front-end rear steps 54F, 54R overlap when seen in forward and backward directions FBD. In other words, the steps 54F, 54R are thickened and reinforced by adding the couplings 51 thereto, so that stresses produced in the couplings 51 by a pivotal displacement of the lock arm 40 are distributed more easily to the steps 54F, 54R. Stated differently, the coupling 51 is thickened in forward and backward directions and reinforced by the steps 54F, 54R to distribute stress in the couplings 51 when the lock arm 40 is displaced pivotally.

Figure 10:
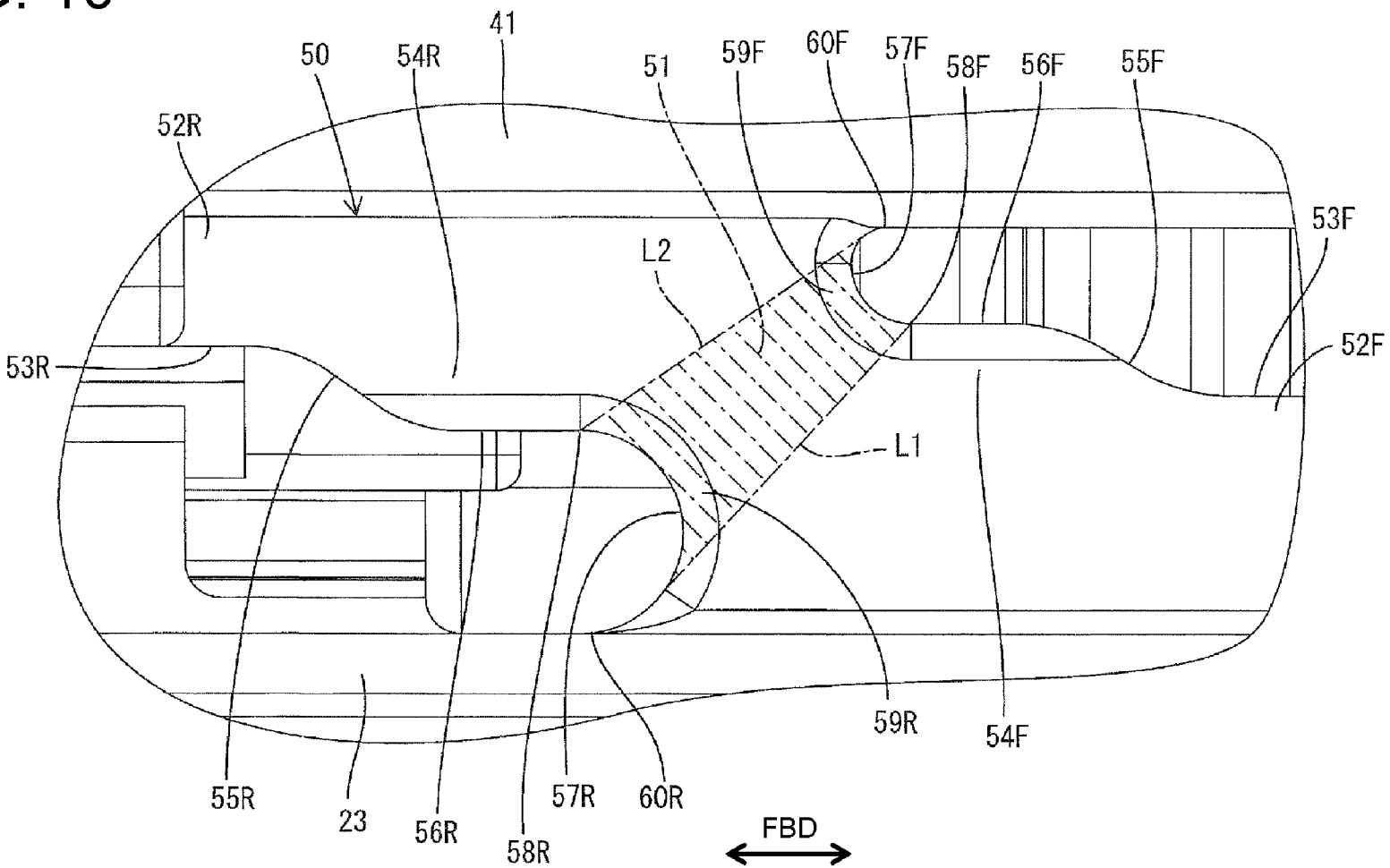
FIG. 10 is a view showing an area of a coupling by dashed-dotted line.
Figure 11:
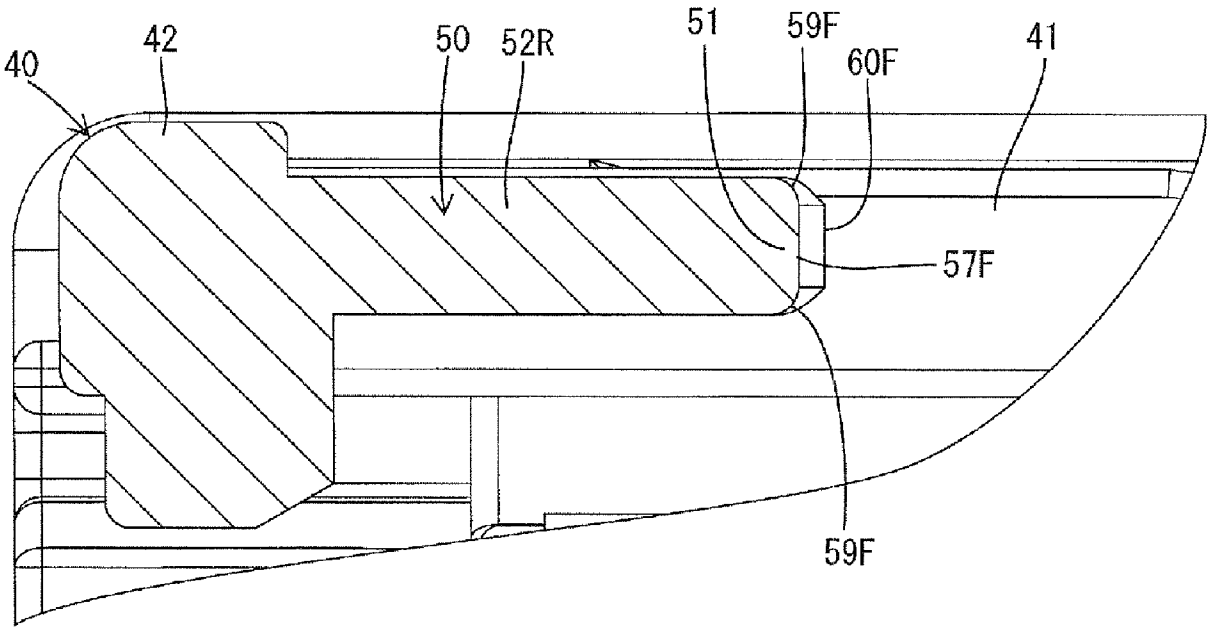
FIG. 11 is an enlarged vertical section along A-A of FIG. 3.
Figure 11:
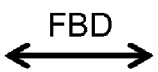
Figure 12:
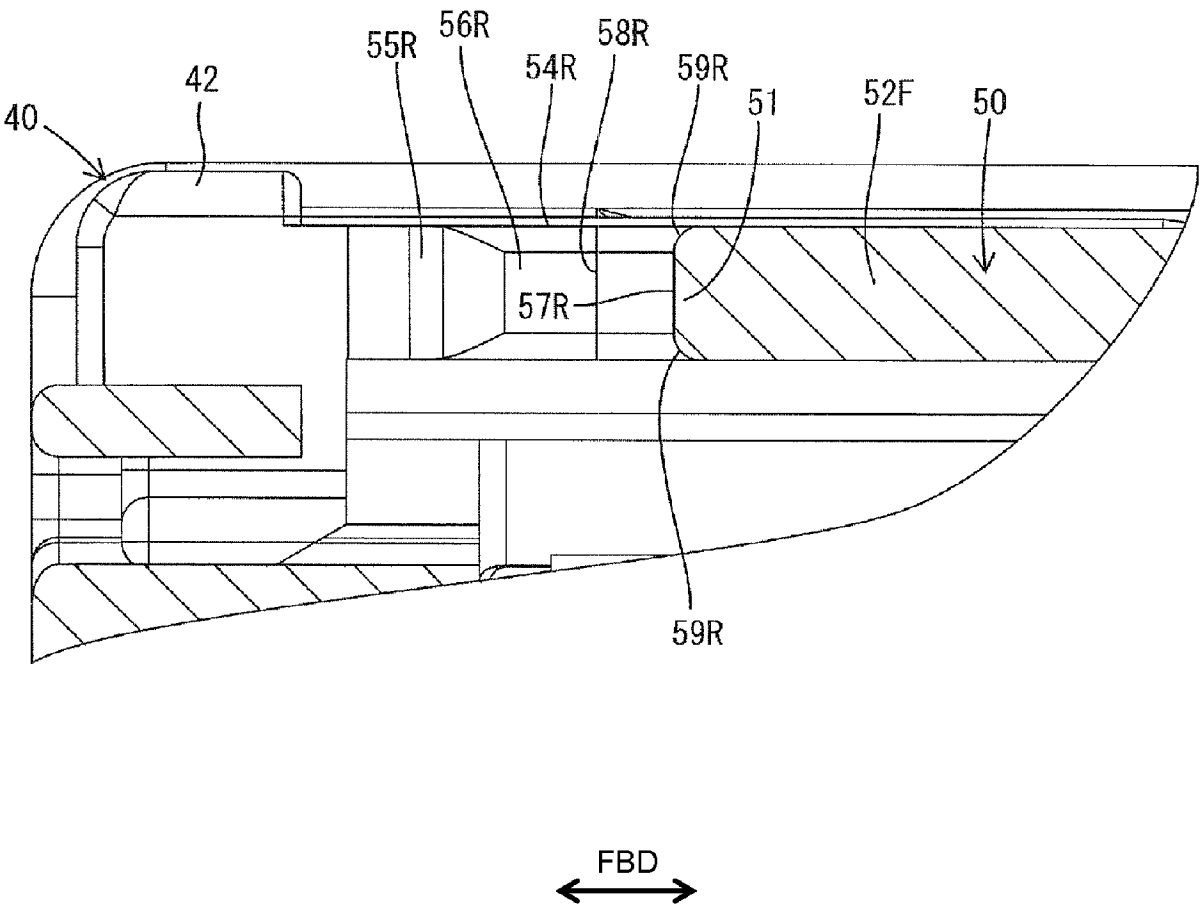
FIG. 12 is an enlarged vertical section along B-B of FIG. 3.

As shown in FIG. 10, the front step 54F has an inclined surface 55F and a longitudinal surface 56F. The inclined surface 55F is inclined moderately and extends substantially back from the rear edge of the front side surface 53F while approaching the arm portion 41. The longitudinal surface 56F extends substantially straight back from the rear edge of this inclined surface 55F. Similarly, the rear step 54R has an inclined surface 55R and a longitudinal surface 56R. The inclined surface 55R is inclined moderately and extends substantially forward from the front edge of the rear side surface 53R while approaching the protection wall 23. The longitudinal surface 56R extends substantially straight forward from the front edge of the inclined surface 55R.

A concavely curved surface 57F is connected to the rear edge of the longitudinal surface 56F of the front step 54F and faces substantially forward via a front slit SF. That is, an end edge 58F of the curved surface 57F that is closer to the rear step 54R in a curving direction is connected to the rear end of the longitudinal surface 56F of the front step 54F. Similarly, a concavely curved surface 57R is connected to the front edge of the longitudinal surface 56R of the rear step 54R and faces substantially backward via a rear slit SR. That is, an end edge 58R of the concavely curved surface 57R closer to the front step 54F in a curving direction is connected to the front end of the longitudinal surface 56R of the rear step 54R. The concavely curved surfaces 57F, 57R are generated about substantially vertical axes. The front and rear curved surfaces 57F, 57R are offset from one another laterally so that the unlocking portion 42 is wider than a front area of the arm portion 41 in the region of the lock hole 43. Furthermore, the rear curved surface 57R is closer to the protection wall 23 and the front curved surface 57F is farther from the protection wall 23 to facilitate pressing the unlocking portion 42 with a finger during an unlocking operation.

As described above, the coupling 51 is located in the hatched area shown by dashed-dotted line in FIG. 10. More specifically, this area is enclosed by a tangent L1 drawn from the end edge 58F of the forward facing concavely curved surface 57F to the backward facing concavely curved surface 57R, a tangent L2 drawn from the end edge 58R of the backward facing concavely curved surface 57R to the forward facing concavely curved surface 57F and the two concavely curved surfaces 57F, 57R when viewed from above. Convex curves 59F, 59R are formed respectively on the upper and lower corners in areas extending from the both curved surfaces 57F, 57R and both longitudinal surfaces 56F, 56R. The curves 59F, 59R are generated about substantially horizontal axes and cross the corners of the coupling 51. Furthermore, the convex curves 59F, 59R are at the four corners of a cross section of the coupling 51. Accordingly, as can be understood from FIGS. 11 and 12, the convex curves 59F, 59R are formed over substantially the entire upper and lower corners of the both concavely curved surfaces 57F, 57R in the coupling 51. Thus, the convex curves 59F, 59R are formed in the entire areas of the upper and lower peripheral edges of each concavely curved surface 57F, 57R in the coupling 51.

Figure 9:
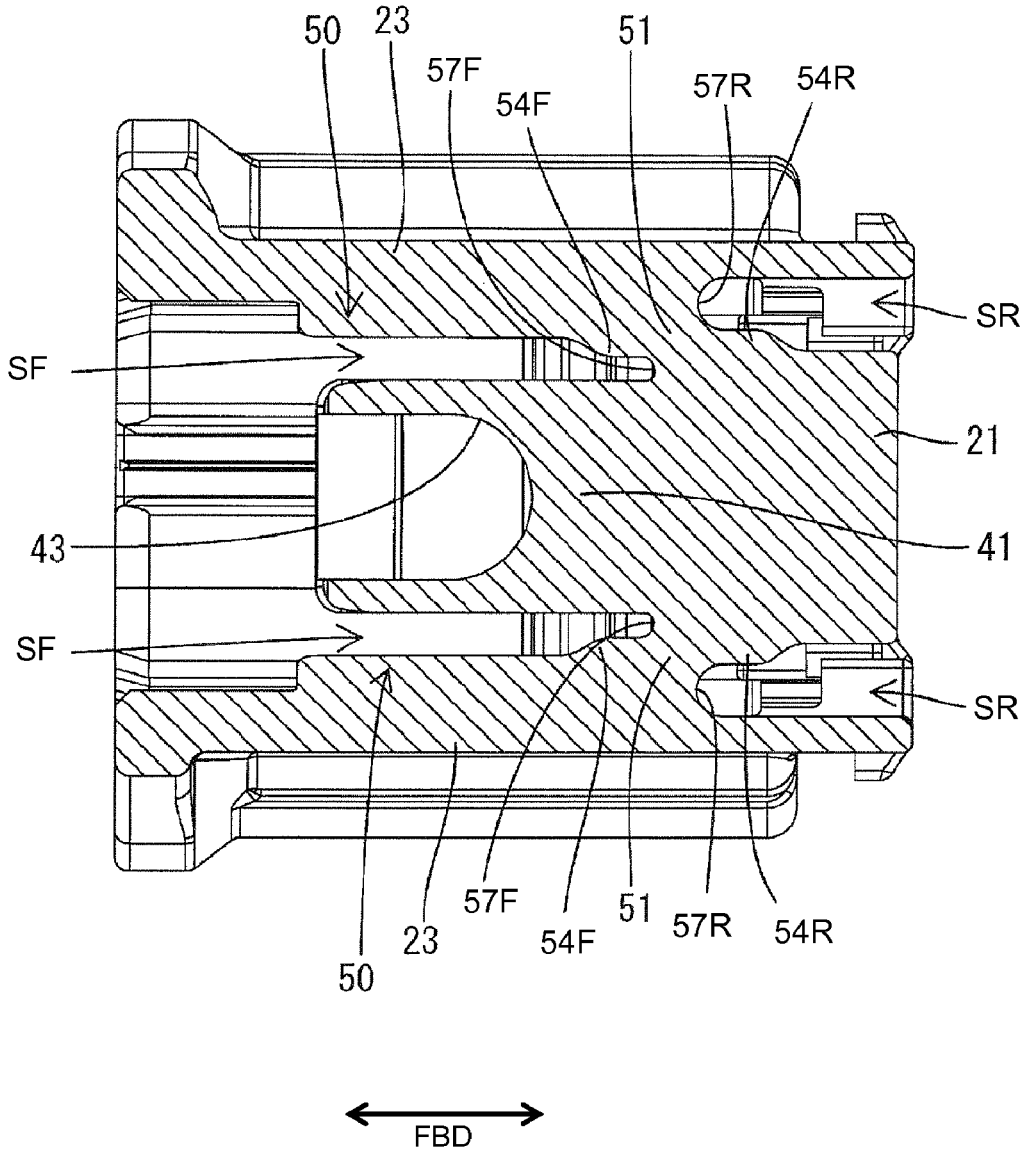
FIG. 9 is a horizontal section along E-E of FIG. 8.

The housing 20 is formed by removing front and rear shaping dies (not shown) in forward and backward directions FBD, and peripheral structures of the coupling portions 51 are formed by pairs of front and rear pins (not shown) at least partly inserted into the slits SF, SR shown in FIG. 9 in forward and backward directions FBD.

The side surfaces of the protection wall 23 and the arm portion 41 extend substantially in the vertical direction VD and the convex curves 59F, 59R disappear at end edges 60F, 60R of these vertical surfaces. On the other hand, for the end edges 58F, 58R connected to the vertical surfaces 56F, 56R of the both steps 54F, 54R, the convex curves 59F, 59R can be continuous with the steps 54F, 54R distant from the protection wall 23 and the arm portion 41. Thus, the convex curves 59F, 59R do not disappear at the end edges 58F, 58R.

As described above, the convex curves 59F, 59R are provided over the entire upper and lower corners of both concavely curved surfaces 57F, 57R of the coupling 51. Accordingly, any torsional stress produced in the coupling 51 will not concentrate on the corners to crack or break the coupling 51. Further, the steps 54F, 54R at the opposite front and rear sides of the coupling 51 reinforce the coupling 51 and stress acting on the coupling 51 can be distributed more easily to the steps 54F, 54R. Further, the steps 54F, 54R are substantially symmetrical with respect to the coupling 51 so that stress can be distributed evenly to the steps 54F, 54R.

The invention is not limited to the above described and illustrated embodiment. For example, the following embodiments are also included in the technical scope of the present invention.

Although the concavely curved surfaces 57F, 57R are displaced in the lateral direction LD in the above embodiment, they may be arranged one after the other according to the invention. In this case, the steps may be provided at each of the left and right sides of each concavely curved surface.

The arm portion 41 of the lock arm 40 is connected to the side surfaces of the protection walls 23 by the couplings 51 in the above embodiment. However, the arm portion 41 may be connected to the upper surface of the inner tube 21 and/or the side surface of one protection wall 23 by a coupling.

The steps 54F, 54R are substantially symmetrical with respect to the coupling 51 and partly overlap in forward and backward directions FBD and are arranged one after the other in the forward and backward directions FBD in the above embodiment. However, the size, arrangement and the like of the steps may be changed.

What is claimed is:

1. A connector, comprising: a housing; lock arm provided displaceably relative to an outer surface of the housing and configured to hold a mating housing and the housing in a connected state; at least one coupling connecting the lock arm and the housing and having front and rear curved surfaces, each of the front and rear curved surfaces extending through a concave arc generated about an axis and each of the concave arcs having opposite ends; a front step extending forward continuously from the end of the concave arc of the front curved surface closer to the rear curved surface; a rear step extending back continuously from the end of the concave arc of the rear curved surface closer to the front curved surface; and two convex curved portions on each of the curved surfaces, the convex curved portions being generated about axes aligned in directions crossing the axes about which the concave arcs are generated.

2. The connector of claim 1, wherein the front and rear steps overlap when seen in forward and backward directions.

3. The connector of claim 1, wherein the front and rear steps are arranged substantially symmetrically with respect to the coupling portion.

4. The connector of claim 1, further comprising two protection walls standing up from the outer surface of the housing at opposite sides of the lock arm; and the at least one coupling comprising two couplings connecting protection walls and the lock arm.

5. The connector of claim 4, wherein the coupling is arranged between the steps.

6. The connector of claim 1, wherein the coupling is located in an area enclosed by a tangent drawn from an end edge of the front curved surface to the rear curved surface, a tangent drawn from an end edge of the rear curved surface to the front curved surface and the both curved surfaces.

7. The connector of claim 4, wherein the front curved surface faces substantially forward via a front slit is connected to a rear end of a vertical surface of the front step and the rear curved surface substantially facing backward via a rear slit is connected to a front end of a vertical surface of the rear step.

8. The connector of claim 4, further comprising a laterally projecting restricting piece on the lock arm and a bulging piece bulging laterally on an inner side surface of the protection wall, the restricting piece and the bulging piece facing vertically to prevent an excessive deformation of the lock arm.

9. The connector of claim 4, further comprising at least one link at a side of the lock arm connecting a side surface of an arm portion of the lock arm and a side surface of the protection wall, the link including at least one beam adjacent the coupling and extending in forward and backward directions.

10. The connector of claim 9, wherein a front beam is wider than a rear beam, and wherein a front surface of the front is closer to the protection wall than a rear surface of the rear beam.

11. The connector of claim 1, wherein the coupling is substantially parallel to the outer surface of the housing and connects a lateral edge of the lock arm to the housing.

12. The connector of claim 1, wherein the curved portions extend along entire areas of the front and rear curved surfaces.

13. The connector of claim 1, wherein the front and rear curved surfaces are offset from one another in a direction crossing a forward and backward direction and a displacing direction of the lock arm.

14. The connector of claim 1, wherein the front step is forward of the coupling and the rear step is rearward of the coupling.

15. A connector, comprising: a housing having opposite front and rear ends and an outer surface, first and second laterally spaced protection walls projecting up from the outer surface and extending substantially in a front to rear direction; a lock arm disposed between and spaced from the protection walls; and first and second couplings connecting the lock arm to the respective first and second protection walls of the housing, each of the couplings having: a lower surface facing the outer surface of the housing and an upper surface facing away from the outer surface of the housing, front and rear concave curves facing respectively toward the front and rear ends of the housing, a front step extending forward from an end of the front concave curve on a side of the respective coupling farther from the lock arm, a rear step extending back from an end of the rear concave curve closer to the lock arm, upper and lower front convex curves extending respectively from the upper and lower surfaces of the coupling to the front concave curve, and upper and lower rear convex curves extending respectively from the upper and lower surfaces of the coupling to the rear concave curve.

16. The connector of claim 15, wherein the front and rear concave curves are generated about axes extending substantially perpendicular to the outer surface of the housing.

17. The connector of claim 16, wherein the front and rear convex curves are generated about axes extending substantially parallel to the outer surface of the housing.

18. The connector of claim 15, wherein the front and rear curves are offset from one another in a lateral direction and in the front to rear direction.

* * * * *